US011444382B2

(12) United States Patent
Kimura

(10) Patent No.: US 11,444,382 B2
(45) Date of Patent: Sep. 13, 2022

(54) ANTENNA DEVICE AND ANTENNA MODULE

(71) Applicant: FUJITSU LIMITED, Kawasaki (JP)

(72) Inventor: Shigekazu Kimura, Yokohama (JP)

(73) Assignee: FUJITSU LIMITED, Kawasaki (JP)

( * ) Notice: Subject to any disclaimer, the term of this patent is extended or adjusted under 35 U.S.C. 154(b) by 17 days.

(21) Appl. No.: 17/223,049

(22) Filed: Apr. 6, 2021

(65) Prior Publication Data

US 2021/0367344 A1 Nov. 25, 2021

(30) Foreign Application Priority Data

May 21, 2020 (JP) ..... JP2020-089141

(51) Int. Cl.

| | |
|---|---|
| ***H01Q 21/08*** | (2006.01) |
| ***H01Q 9/16*** | (2006.01) |
| ***H01Q 21/06*** | (2006.01) |
| ***H01Q 3/26*** | (2006.01) |

(52) U.S. Cl.
CPC ..... *H01Q 9/16* (2013.01); *H01Q 3/26* (2013.01); *H01Q 21/065* (2013.01)

(58) Field of Classification Search
CPC ..... H01Q 9/16; H01Q 3/26; H01Q 21/065
See application file for complete search history.

(56) References Cited

U.S. PATENT DOCUMENTS

2018/0159203 A1* 6/2018 Baks ..... H01Q 1/48

FOREIGN PATENT DOCUMENTS

| | | |
|---|---|---|
| JP | 2006-238294 A | 9/2006 |
| JP | 2006-261941 A | 9/2006 |

OTHER PUBLICATIONS

Xiaoxiong Gu et al., "A Multilayer Organic Package with 64 Dual-Polarized Antennas for 28GHz 5G Communication", 2017 IEEE, pp. 1899-1901, 2017 (Total 3 pages).

* cited by examiner

*Primary Examiner* — Dieu Hien T Duong
(74) *Attorney, Agent, or Firm* — Fujitsu Patent Center

(57) ABSTRACT

An antenna device includes an antenna element and a dummy antenna element. The antenna element is configured to construct a patch antennae. The dummy antenna is coupled to a ground layer by a conductive through portion which pass through a substrate in a thickness direction. A position of the conductive through portion with respect to the dummy antenna element is a first position on a straight line that divides an angle between a first straight line and a second straight line, or a second position in the neighborhood of the first position. The first straight pass through a first feed point and a center of dummy antenna element. The second straight passing through a second feed point and the center. The first feed point and the second feed point being feed points when the dummy antenna element generates circularly polarized waves.

11 Claims, 18 Drawing Sheets

ANTENNA DEVICE AND ANTENNA MODULE

CROSS-REFERENCE TO RELATED APPLICATION

This application is based upon and claims the benefit of priority of the prior Japanese Patent Application No. 2020-89141, filed on May 21, 2020, the entire contents of which are incorporated herein by reference.

FIELD

The embodiment discussed herein is related to an antenna device and an antenna module.

BACKGROUND

Typically, there is a directional antenna that includes a feeding element and at least one non-feeding element arranged around the feeding element and controls an emission intensity distribution of electromagnetic waves by grounding a current induced by the non-feeding element via a short-circuit line provided in the non-feeding element. The feeding element is characterized in that the feeding element selects a main resonance and a higher-order resonance and executes the selected resonance.

Japanese Laid-open Patent Publication No. 2006-238294 is disclosed as related art.

SUMMARY

According to an aspect of the embodiments, an apparatus includes an antenna device includes a substrate; a ground layer provided on a first surface of the substrate or in an inner layer of the substrate; a plurality of antenna elements arranged on a second surface of the substrate in an array; a plurality of dummy antenna elements arranged around the plurality of antenna elements in a plan view, wherein the plurality of antenna elements includes an antenna element, the antenna element is configured to construct a patch antennae, the plurality of dummy antenna elements includes a dummy antenna, the dummy antenna is coupled to the ground layer by a conductive through portion, the conductive through portion passing through the substrate in a thickness direction and having conductivity, and a position of the conductive through portion with respect to the dummy antenna element in a plan view is a first position on a straight line that evenly divides an angle between a first straight line and a second straight line, or a second position in the neighborhood of the first position, the first straight passing through a first feed point and a center of dummy antenna element, the second straight passing through a second feed point and the center of dummy antenna element, the first feed point and the second feed point being feed points when the dummy antenna element generates circularly polarized waves.

The object and advantages of the invention will be realized and attained by means of the elements and combinations particularly pointed out in the claims.

It is to be understood that both the foregoing general description and the following detailed description are exemplary and explanatory and are not restrictive of the invention.

DESCRIPTION OF EMBODIMENTS

A typical directional antenna does not improve emission characteristics of an antenna element that is arranged on the outermost side among a plurality of antenna elements arranged in an array.

Therefore, an object is to provide an antenna device and an antenna module that improve emission characteristics of a plurality of antenna elements arranged in an array.

Hereinafter, an embodiment to which an antenna device and an antenna module are applied will be described.

Embodiment

Figure 1:
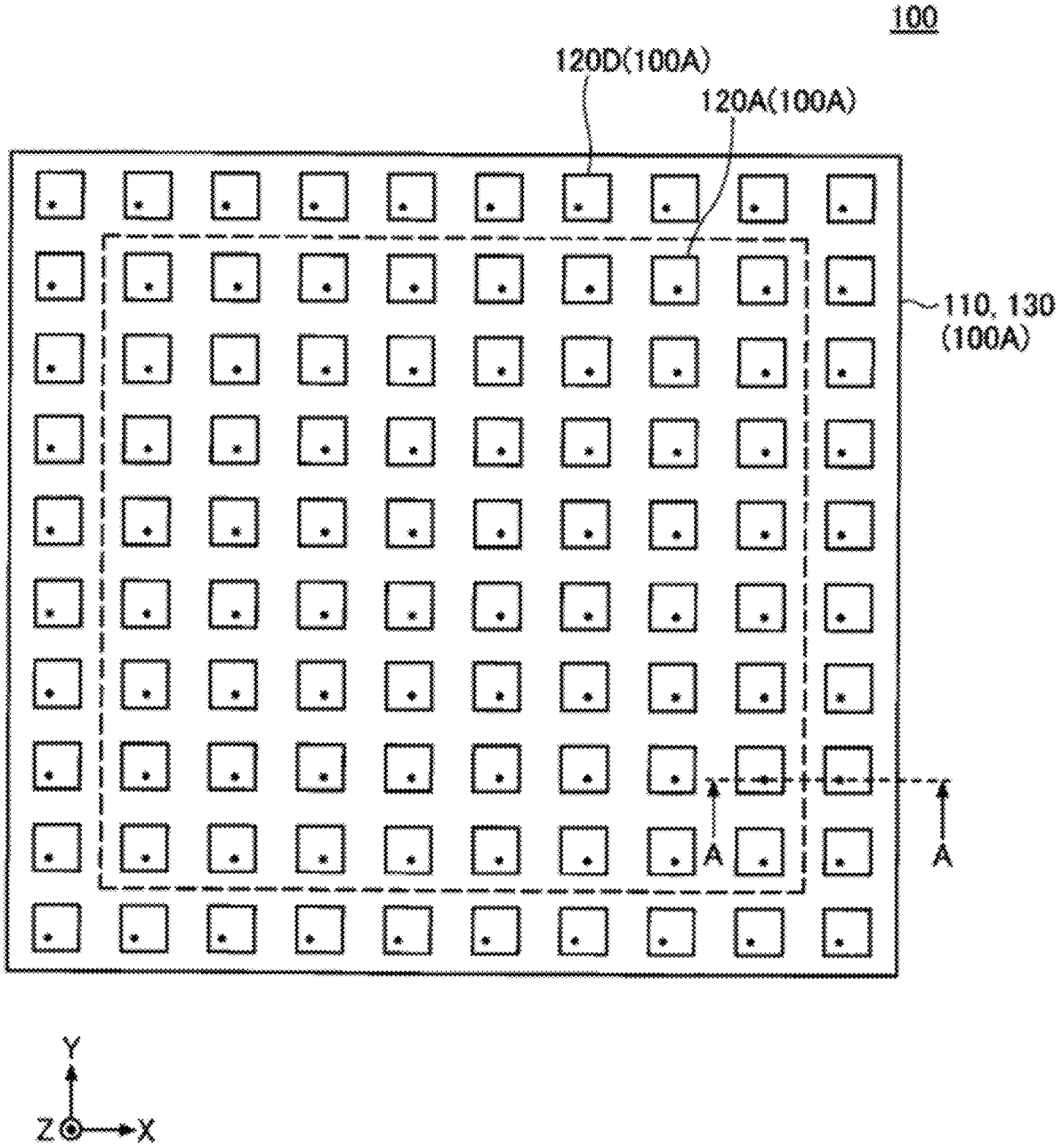
FIG. 1 is a diagram illustrating an antenna module 100 including an antenna device 100A according to an embodiment.
Figure 2:
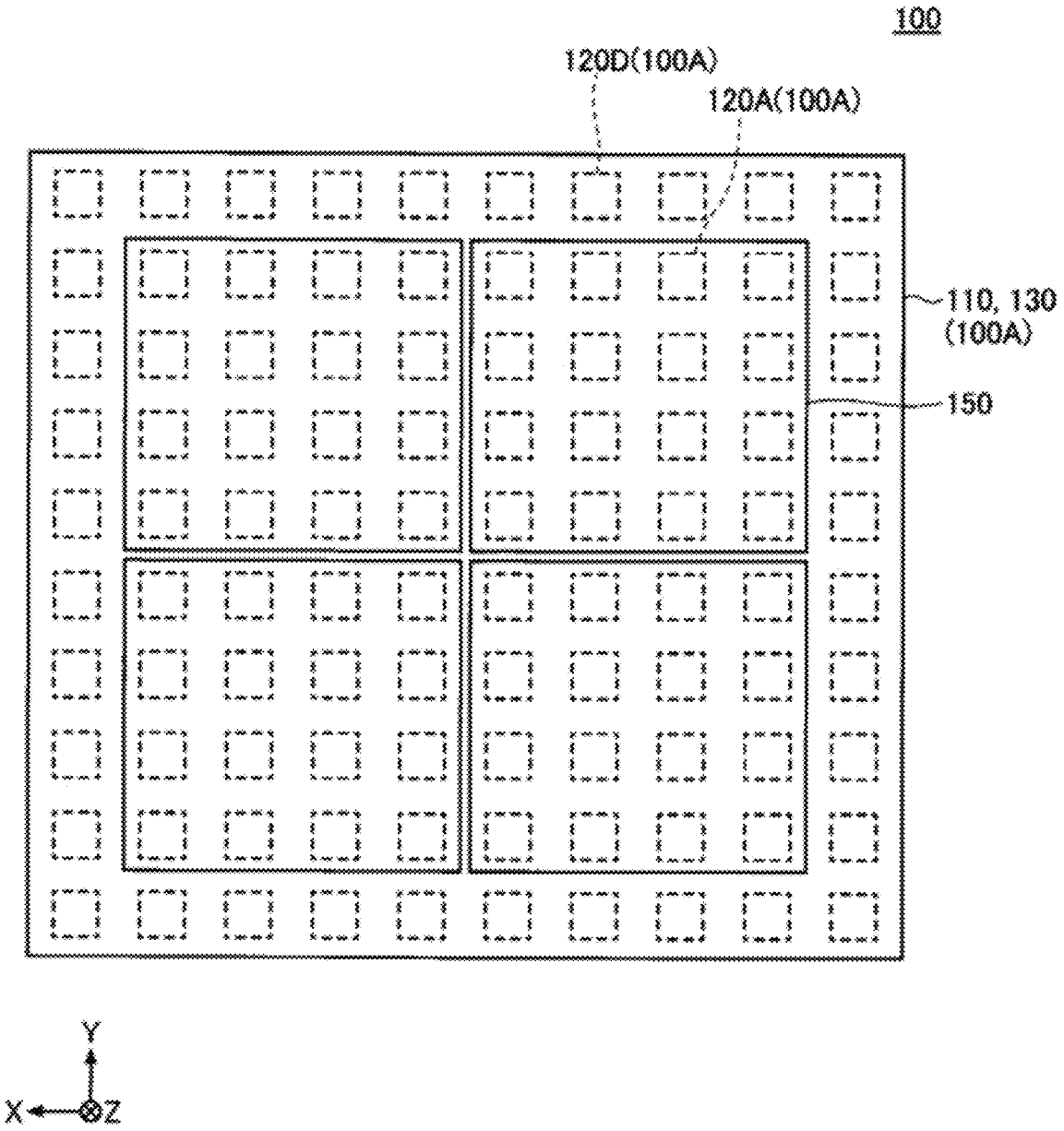
FIG. 2 is a diagram illustrating the antenna module 100 including the antenna device 100A according to the embodiment.

FIGS. 1 and 2 are diagrams illustrating an antenna module 100 including an antenna device 100A according to an embodiment. Hereinafter, description will be given while defining an XYZ coordinate system. Furthermore, in the following, the plan view indicates an XY plane view. For convenience of the description, the −Z direction side is indicated as a lower side or below, and the +Z direction side is indicated as an upper side or above. However, this does not represent a universal vertical relationship. In FIG. 1, an upper surface side of the antenna module 100 is illustrated. In FIG. 2, a lower surface side of the antenna module 100 is illustrated.

The antenna module 100 includes a substrate 110, an antenna element 120A, a dummy antenna element 120D, a ground layer 130, and an integrated circuit (IC) 150. The antenna module 100 includes the antenna device 100A that performs 5G (fifth generation) communication as an example. The antenna device 100A includes the substrate 110, the antenna element 120A, the dummy antenna element 120D, and the ground layer 130. Therefore, the substrate 110, the antenna element 120A, the dummy antenna element 120D, and the ground layer 130 are denoted with a reference numeral 100A in parentheses.

A communication frequency of the antenna device 100A is a 3.7 GHz band, a 4.5 GHz band, or a 28 GHz band as an example. Here, as an example, a form will be described in which the communication frequency of the antenna device 100A is a frequency that belongs to the 28 GHz band.

Figure 3A:
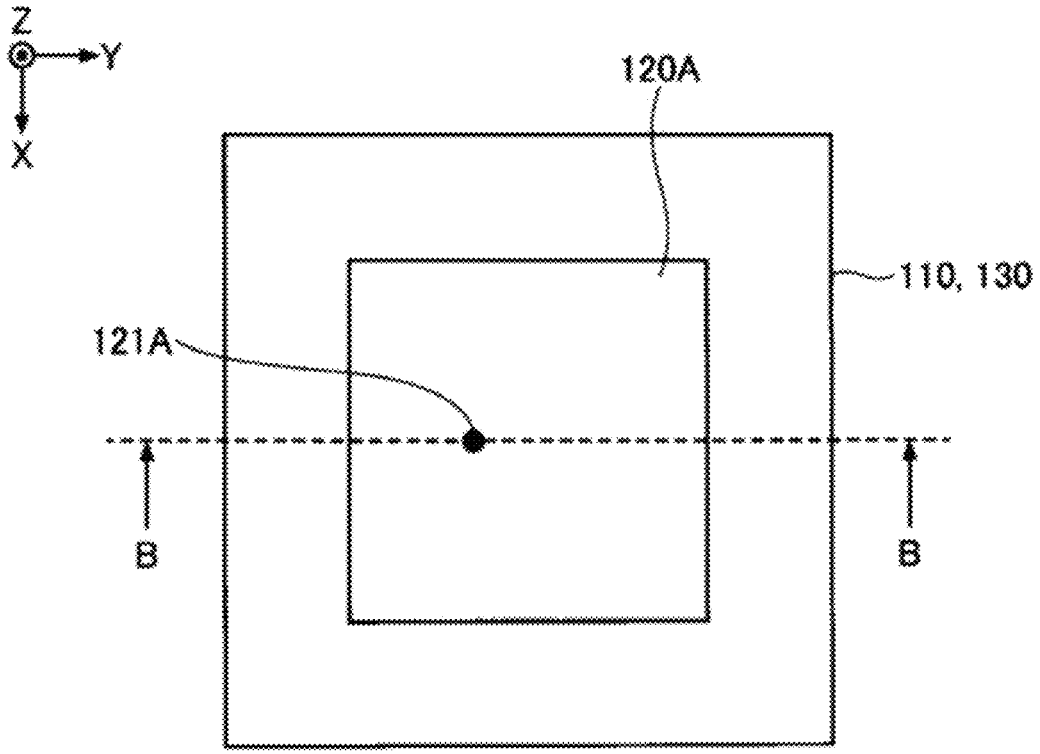
FIG. 3A is diagram illustrating a portion corresponding to a single antenna element 120A.
Figure 3B:
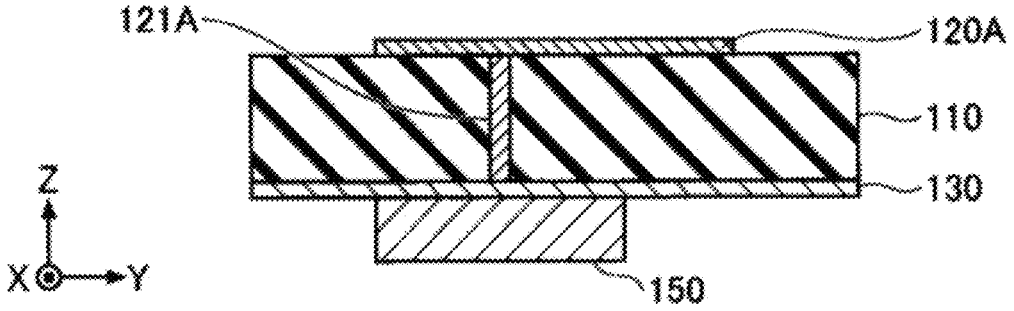
FIG. 3B is diagram illustrating a portion corresponding to a single antenna element 120A.
Figure 4A:
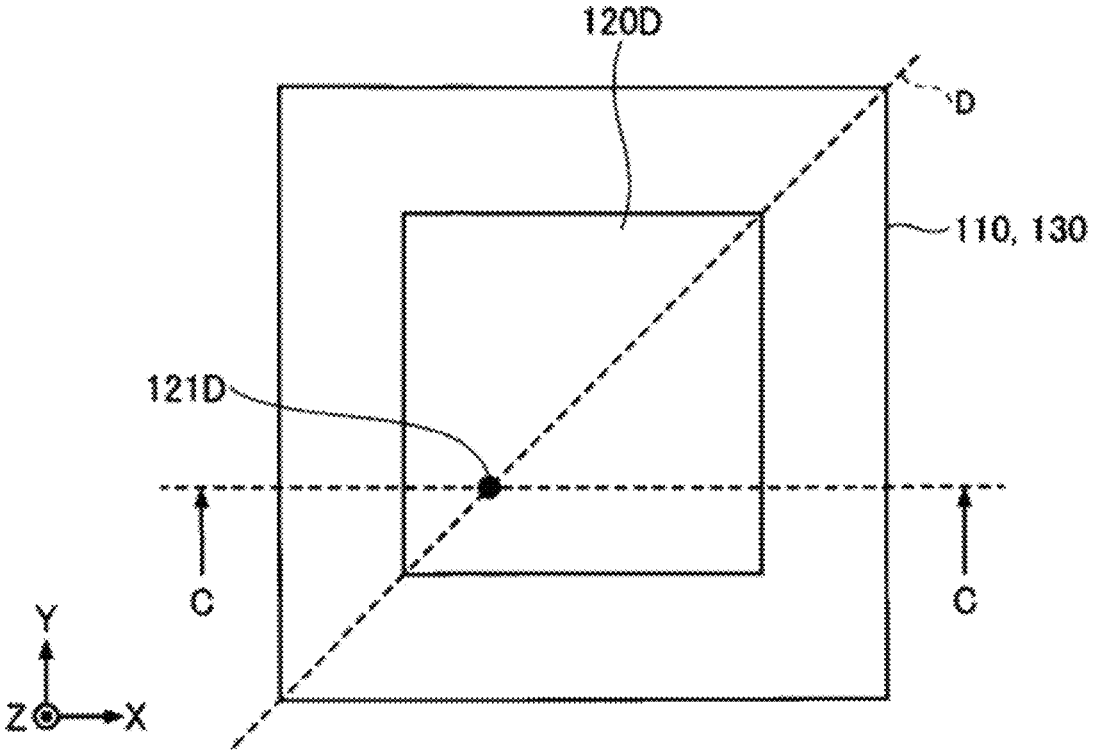
FIG. 4A is diagram illustrating a portion corresponding to a single dummy antenna element 120D.
Figure 4B:
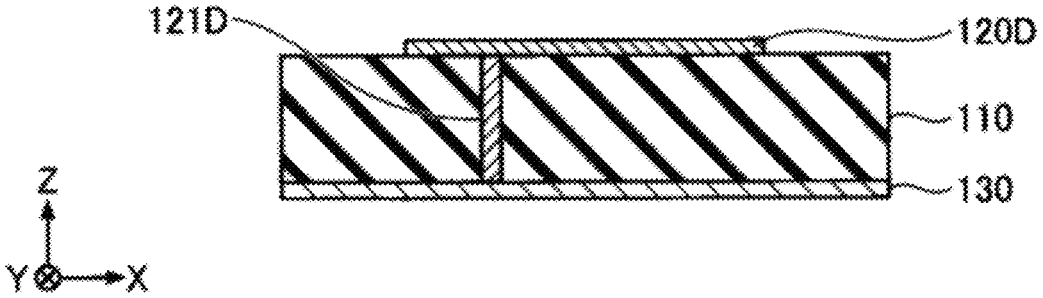
FIG. 4B is diagram illustrating a portion corresponding to a single dummy antenna element 120D.

In the following, description will be made with reference to FIGS. 3A, 38, 4A, and 48 in addition to FIGS. 1 and 2. FIGS. 3A and 3B are diagrams illustrating a portion corresponding to the single antenna element 120A included in the antenna module 100. FIGS. 4A and 4B are diagrams illustrating a portion corresponding to the single dummy antenna element 120D included in the antenna module 100. FIGS. 3A and 4A illustrate configurations in a plan view, and FIGS. 3B and 48 illustrate configurations along a cross section taken along a line B-B and a cross section taken along a line C-C.

The substrate 110 is a Flame Retardant type 4 (FR4) standard wiring board as an example. The antenna element 120A and the dummy antenna element 120D are provided on the upper surface, and the ground layer 130 is provided on the lower surface. The lower surface of the substrate 110 is an example of a first surface, and the upper surface is an example of a second surface.

A square indicated by a broken line in FIG. 1 indicates a boundary between a region where the plurality of antenna elements 120A is arranged and a region where the plurality of dummy antenna elements 120D is arranged. Furthermore, as illustrated in FIGS. 3A, 38, 4A, and 48, through-holes 121A and 121D that pass through the substrate 110 in a thickness direction are provided. Furthermore, as illustrated in FIGS. 2, 3A, 3B, 4A, and 4B, the IC 150 is mounted on the lower side of the ground layer 130. Here, a configuration of the IC 150 mounted on the ground layer 130 is simplified and illustrated. One IC 150 may be provided for the plurality of antenna elements 120A (for example, one for 16 antenna elements 120A) or may be provided for each antenna element 120A.

As Illustrated in FIG. 1, the antenna elements 120A are arranged in an array on the upper surface of the substrate 110, and as an example, 64 (8×8) antenna elements 120A are arranged at equal pitches in an X direction and a Y direction. The arrangement of the antenna element 120A may be regarded as a matrix. The shape of the antenna element 120A is a square in a plan view, and a length of one side is set to about ½ of an electrical length of a wavelength in the communication frequency. Because the ground layer 130 is provided on the lower surface of the substrate 110 in which the antenna elements 120A are arranged on the upper surface and all the antenna elements 120A and the ground layer 130 are overlapped in a plan view, the antenna elements 120A and the ground layer 130 form a patch antenna.

Electric power is supplied to each antenna element 120A via the through-hole 121A and wiring of the substrate 110. As illustrated in FIGS. 3A and 3B, a point where the through-hole 121A is coupled to the antenna element 120A is a feeding point. The through-hole 121A extends in a direction parallel to the Z direction. As illustrated in FIGS. 3A and 3B, a position of the through-hole 121A in a plan view is a position offset from the center of the antenna element 120A in a plan view in the −Y direction. An excitation direction of the antenna element 120A is the Y direction. A phase of radio waves emitted from the plurality of antenna elements 120A is adjusted by the IC 150, and the radio waves construct a single beam.

As illustrated in FIG. 1, the dummy antenna elements 120D are arranged to surround the plurality of antenna elements 120A on the upper surface of the substrate 110. Here, as an example, the 64 (8×8) antenna elements 120A are arranged. Therefore, as an example, total 36 dummy antenna elements 120D are arranged, 10 dummy antenna elements 120D are arranged in the X direction, and 10 dummy antenna elements 120D are arranged in the Y direction. Although the number of lines of dummy antenna elements 120D surrounding the plurality of antenna elements 120A is one in FIG. 1, the number of lines may be equal to or more than two.

The dummy antenna element 120D has a shape equal to that of the antenna element 120A in a plan view and has an equal size. Therefore, the shape of the dummy antenna element 120D is a square in a plan view as an example. Further, as an example, a length of one side is set to about ½ of the electrical length of the wavelength in the communication frequency, and is equal to the length of the one side of the antenna element 120A. All the dummy antenna elements 120D are overlapped with the ground layer 130 in a plan view, similarly to the antenna element 120A.

Pitches between the dummy antenna elements 120D in the X direction and the Y direction and pitches between the dummy antenna element 120D and the antenna element 120A adjacent to the dummy antenna element 120D in the X direction and the Y direction are equal to pitches between the antenna elements 120A in the X direction and the Y direction. Therefore, all the antenna elements 120A and all the dummies are arranged at equal pitches in the X direction and the Y direction. Note that, the pitch is an interval between the centers of the widths in the X direction and the Y direction.

As Illustrated in FIGS. 4A and 4B, each dummy antenna element 120D is coupled to the ground layer 130 via the through-hole 121D. The through-hole 121D is an example of a conductive through portion and extends in a direction parallel to the Z direction. A position where the dummy antenna element 120D is coupled to the through-hole 121A is on a diagonal line D of the square of the dummy antenna element 120D as illustrated in FIGS. 4A and 4B, and offsets from the center of the square of the dummy antenna element 120D in the −X direction and the −Y direction. It is sufficient that a through-hole is formed through the substrate 110 by drilling or the like the substrate 110 and the through-hole 121D be formed inside of the through hole by plating or the like.

The dummy antenna element 120D is provided to improve emission characteristics of the antenna element 120A that is arranged outermost among the plurality of antenna elements 120A. Here, because the 64 (8×8) antenna elements 120A are arranged, the number of antenna elements 120A arranged outermost is 28. The antenna elements 120A exist adjacent to, in the X direction and the Y direction, the 36 antenna elements 120A positioned on the inner side of the 28 antenna elements 120A arranged outermost. However, because the antenna elements 120A exist only on one side in the X direction and the Y direction for the 28 antenna elements 120A arranged outermost, the emission characteristics of the 28 antenna elements 120A are different from those of the 36 antenna elements 120A on the inner side.

In order to make the emission characteristics of such 28 antenna elements 120A arranged outermost be equivalent to those of the 36 antenna elements 120A positioned on the inner side, the 36 dummy antenna elements 120D having the same planar shape as the antenna element 120A are arranged on the outer side of the 28 antenna elements 120A arranged outermost.

Here, in order to make impedance characteristics of the dummy antenna element 120D be equal to impedance characteristics of the antenna element 120A, it is considered to couple a dummy IC similar to the IC 150 to the dummy antenna element 120D or end the dummy antenna element 120D using a 50Ω resistor. However, the dummy IC needs a space, is not used to control a phase, and is expensive. Furthermore, the number of types of 50Ω terminating resistors that can be used in a millimeter wave band such as 28 GHz is limited, and the terminating resistors need space and are expensive. Because it is not possible to arrange the dummy IC and the 50Ω terminating resistor in the substrate 110, the dummy IC and the 50Ω terminating resistor are arranged on the lower surface side of the substrate 110.

Therefore, in the embodiment, the dummy antenna element 120D is coupled to the ground layer 130 by the through-hole 121D without using the dummy IC or the 50Ω terminating resistor. A position of the through-hole 121D is a position of a feeding point in a case where electric power is supplied to the dummy antenna element 120D at one point to generate circularly polarized waves. The position of such a feeding point is a position on one of two diagonal lines of the square dummy antenna element 120D, and is a position offset from the center of the square dummy antenna element 120D. Therefore, here, as illustrated in FIGS. 4A and 4B, the through-hole 121D is coupled at the position offset from the center on the diagonal line D of the square dummy antenna element 120D, and the dummy antenna element 120D is coupled to the ground layer 130 via the through-hole 121D. The characteristics of the dummy antenna element 120D coupled to the through-hole 121D at such a position will be described later with reference to FIGS. 9 to 16.

Note that, the dummy has a genuine appearance. In other words, for example, the dummy is used for an intended use different from the original intended use using the characteristics of the original and is not used for the original intended use. The dummy antenna element 120D is an element that is not used as an antenna element that transmits or receives radio waves and is used to improve the emission characteristics of the outermost antenna element 120A using electrical characteristics of an element having the same shape as the antenna element 120A. Furthermore, the above-described dummy IC is not used for an intended use as an IC and is used as an electronic component having an impedance equivalent to the IC 150 that performs phase control.

The ground layer 130 is provided on the lower surface of the substrate 110. The ground layer 130 is provided across the entire lower surface of the substrate 110 in FIGS. 1 and 2, and is overlapped with all the antenna elements 120A and all the dummy antenna elements 120D in a plan view. Note that, the antenna element 120A and the dummy antenna element 120D can be manufactured by patterning a metal foil provided on the upper surface of the substrate 110, and the ground layer 130 may be a metal foil provided on the lower surface of the substrate 110. Such a metal foil is a copper foil or an aluminum foil, as an example.

As an example, the IC 150 is coupled to all the antenna elements 120A via wiring, a Ball Grid Array (BGA), and the through-hole 121A provided on the substrate 110. The IC 150 adjusts a phase of electric power supplied to all the antenna elements 120A and adjusts directivity of a single beam constructed by the radio waves emitted from all the antenna elements 120A.

Figure 5:
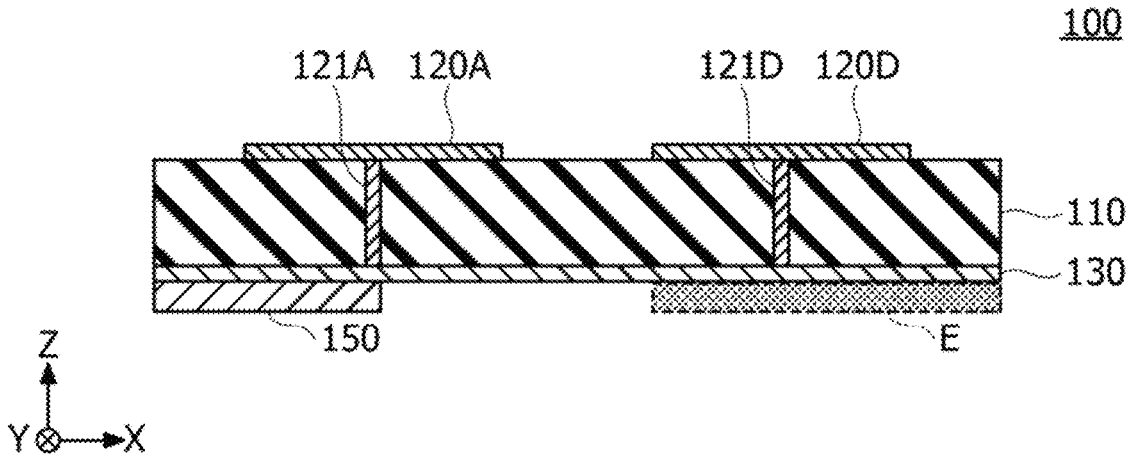
FIG. 5 is a diagram illustrating a cross-section taken along a line A-A in FIG. 1.

FIG. 5 is a diagram illustrating a cross-section taken along a line A-A in FIG. 1. In the antenna module 100, because the dummy antenna element 120D is coupled to the ground layer 130 via the through-hole 121D, a component of the antenna module 100 is not arranged in a space E positioned on the lower side of the dummy antenna element 120D of a space below the ground layer 130. Therefore, space saving can be achieved. Because the 36 dummy antenna elements 120D are arranged, an effect of such space saving is large, and other circuits or the like can be arranged in the space E.

Figure 6:
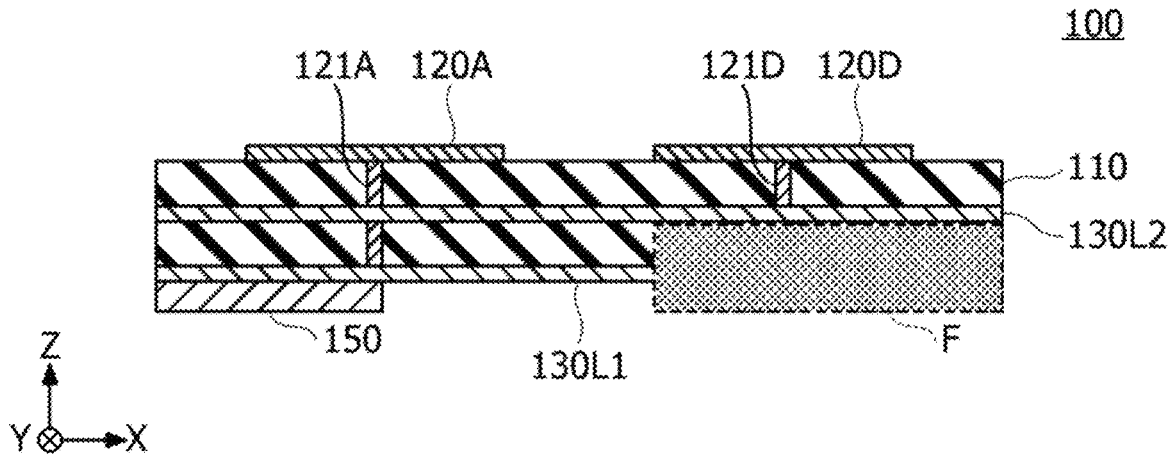
FIG. 6 is a diagram illustrating a modification of the configuration illustrated in FIG. 5.

FIG. 6 is a diagram illustrating a modification of the configuration illustrated in FIG. 5. In FIG. 6, the substrate 110 includes ground layers 130L1 and 130L2. Although the ground layer 130L1 is provided on the lower surface of the substrate 110 similarly to the ground layer 130 illustrated in FIG. 5, the ground layer 130L1 is not coupled to the through-hole 121D. The substrate 110 illustrated in FIG. 6 includes the ground layer 130L2 as an inner layer. The substrate 110 may include an inner layer in this way.

The ground layer 130L2 is a ground layer for the antenna element 120A and the dummy antenna element 120D and is one of the inner layers of the substrate 110. The substrate 110 may include an inner layer for wiring in addition to the ground layer 130L2. The ground layer 130L2 is coupled to the through-hole 121D. In a case of such a configuration, a component of the antenna module 100 is not arranged in a space F positioned on the lower side of the dummy antenna element 120D of a space below the ground layer 130L2. Therefore, space saving can be further achieved. Because the 36 dummy antenna elements 120D are arranged, an effect of such space saving is very large, and other circuits or the like can be arranged in the space F.

Figure 7:
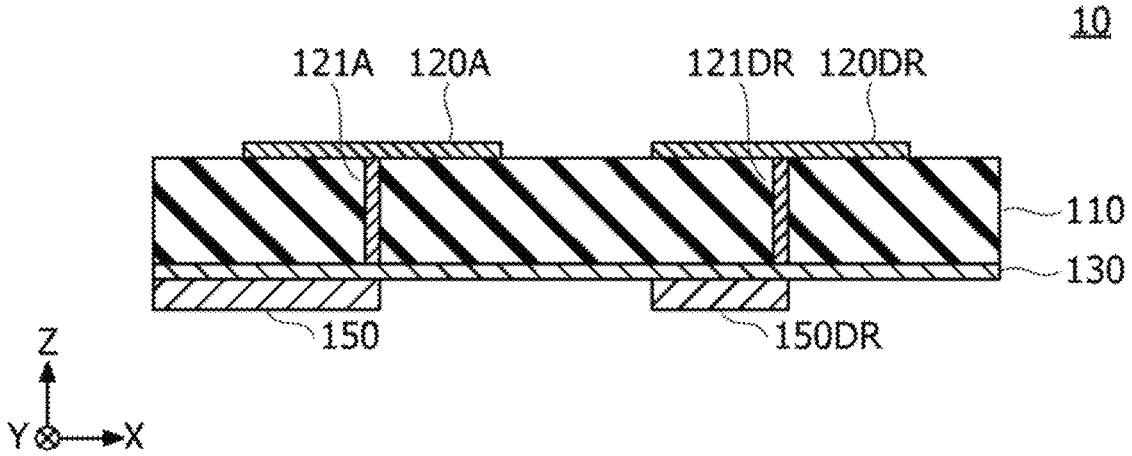
FIG. 7 is a diagram illustrating a cross-sectional configuration of an antenna module 10 for comparison.

FIG. 7 is a diagram illustrating a cross-sectional configuration of an antenna module 10 for comparison. The antenna module 10 for comparison has a configuration that includes a dummy antenna element 120DR and a through-hole 121DR instead of the dummy antenna element 120D and the through-hole 121D of the antenna module 100 and further includes a dummy IC 150DR. Although the dummy antenna element 120DR has a configuration similar to the dummy antenna element 120D, a position of the through-hole 121DR in a plan view is equal to the through-hole 121A. Furthermore, the dummy antenna element 120DR is coupled to the dummy IC 150DR via the through-hole 121DR. In such a configuration, the dummy IC 150DR is arranged in the space E positioned on the lower side of the dummy antenna element 120DR of the space below the ground layer 130. Therefore, the dummy IC 150DR takes space. Furthermore, because the dummy IC 150DR is included, cost increases. On the other hand, the antenna module 100 illustrated in FIGS. 5 and 6 can achieve space saving and cost reduction.

Figure 8A:
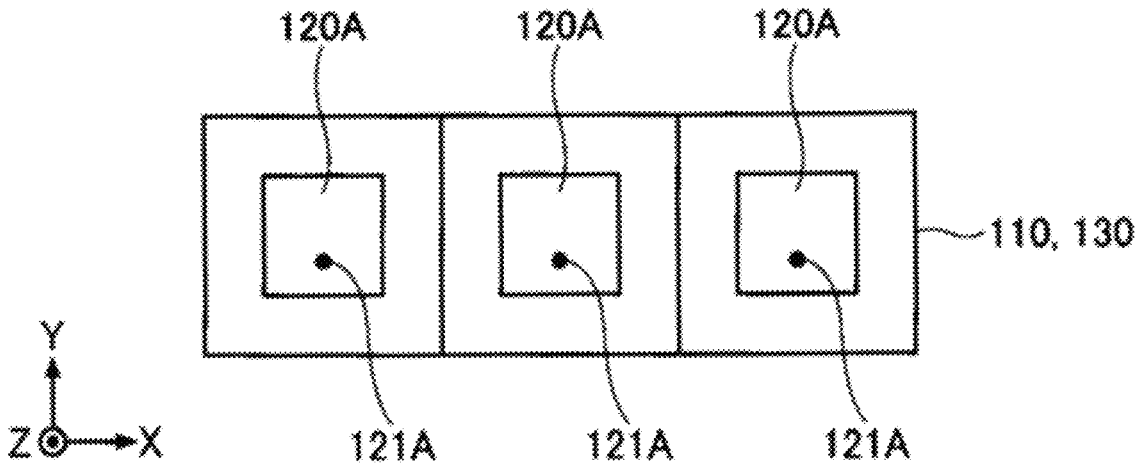
FIG. 8A is diagram illustrating a simulation model.
Figure 8B:
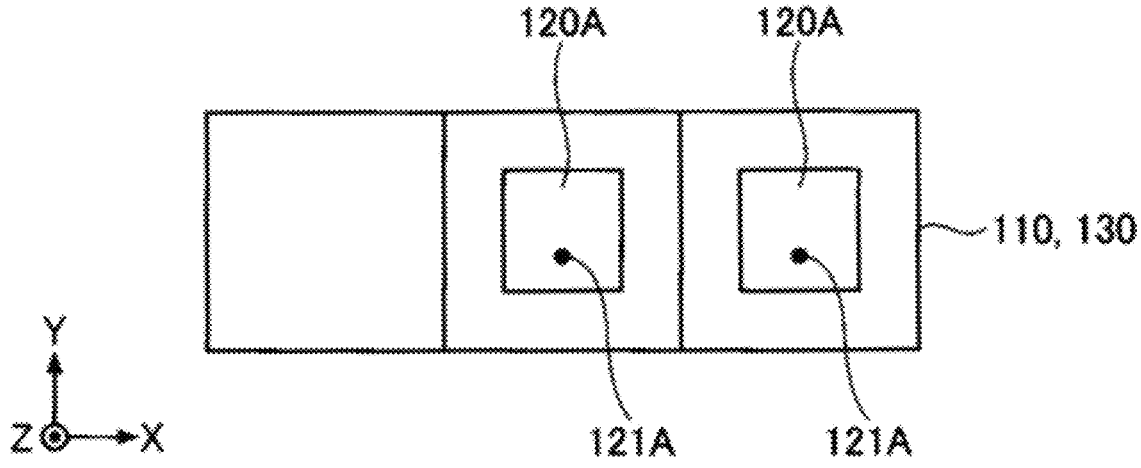
FIG. 8B is diagram illustrating a simulation model.
Figure 8C:
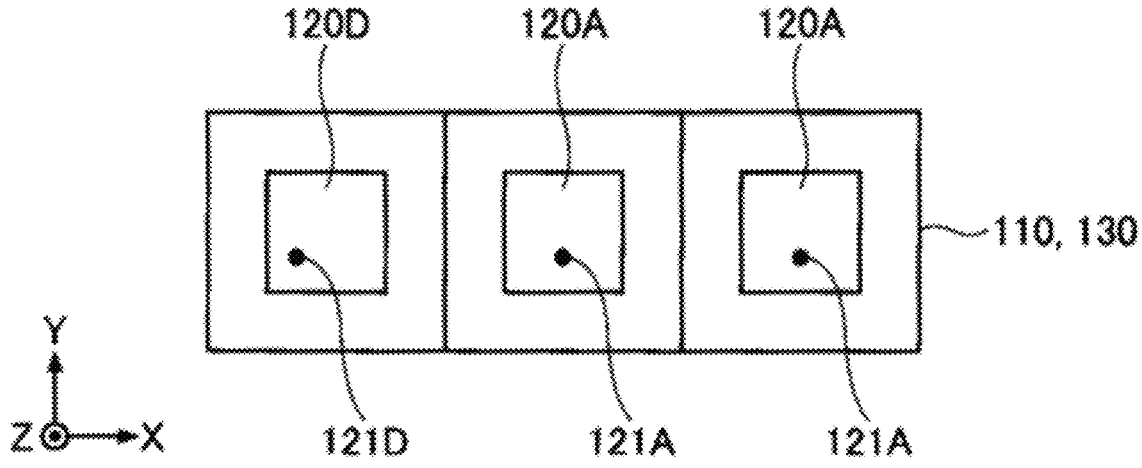
FIG. 8C is diagram illustrating a simulation model.

FIGS. 8A to 8C are diagrams illustrating a simulation model. FIG. 8A illustrates three antenna elements 120A arranged in the X direction. On both sides of the central antenna element 120A of the three, the antenna elements 120A are arranged similarly to the 36 antenna elements 120A on the inner side of the outermost 28 antenna elements 120A of the 64 antenna elements 120A in FIG. 1. In the simulation, emission characteristics of the central antenna element 120A are obtained.

FIG. 8B illustrates a simulation model in which the leftmost antenna element 120A is removed from FIG. 8A. In the simulation, emission of the left-side antenna element 120A of the two is obtained. In other words, for example, in the simulation model in FIG. 8B, the emission characteristics of the central antenna element 120A in FIG. 8A in a case where the left-side antenna element 120A does not exist are obtained.

FIG. 8C illustrates a simulation model in which the leftmost antenna element 120A in FIG. 8A is replaced with the dummy antenna element 120D. In the simulation, the emission characteristics of the antenna element 120A positioned at the center (antenna element 120A on right side of dummy antenna element 120D) are obtained.

Figure 9:
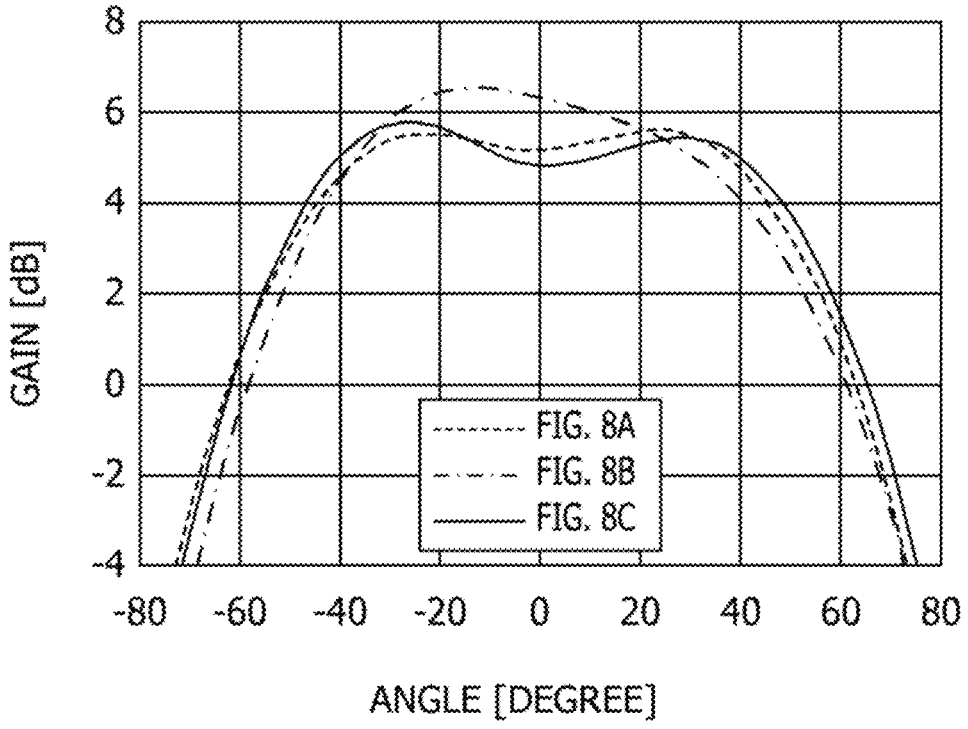
FIG. 9 is a diagram illustrating angular characteristics of a gain obtained by the simulation models illustrated in FIGS. 8A to 8C.

FIG. 9 is a diagram illustrating angular characteristics of gains obtained in the simulation models illustrated in FIGS. 8A to 8C. An angle of the horizontal axis indicates an angle on an XZ plane, and zero degree indicates the +Z direction, 90 degrees indicates the +X direction, and −90 degrees indicates the −X direction. However, the horizontal axis indicates a range from −80 degrees to +80 degrees. The vertical axis indicates a gain (dB). Such characteristics are characteristics obtained by obtaining the emission characteristics of the three simulation models. Furthermore, the characteristics of the simulation model in FIG. BA are indicated by a broken line, the characteristics of the simulation model in FIG. 8(B) are indicated by an alternate long and short dash line, and the characteristics of the simulation model in FIG. 8C are indicated by a solid line.

As illustrated in FIG. 9, the characteristics of the simulation model in FIG. 8C indicated by the solid line indicate tendency similar to the characteristics of the simulation model in FIG. BA indicated by the broken line. When the characteristics of the simulation model in FIG. 8C indicated by the solid line are compared with the characteristics of the simulation model (with no dummy antenna element 120D) in FIG. 8B indicated by the alternate long and short dash line, it is found that the characteristics of the simulation model in FIG. 8C change so as to approach the characteristics of the simulation model in FIG. 8A in which the antenna elements 120A are arranged on both sides. Therefore, it was confirmed that the emission characteristics are improved by arranging the dummy antenna element 120D on the outer side of the outermost antenna element 120A. Such improvement can be regarded as reducing an effect of the ground layer 130 on the right side of the central antenna element 120A illustrated in FIG. 8B.

Figure 10:
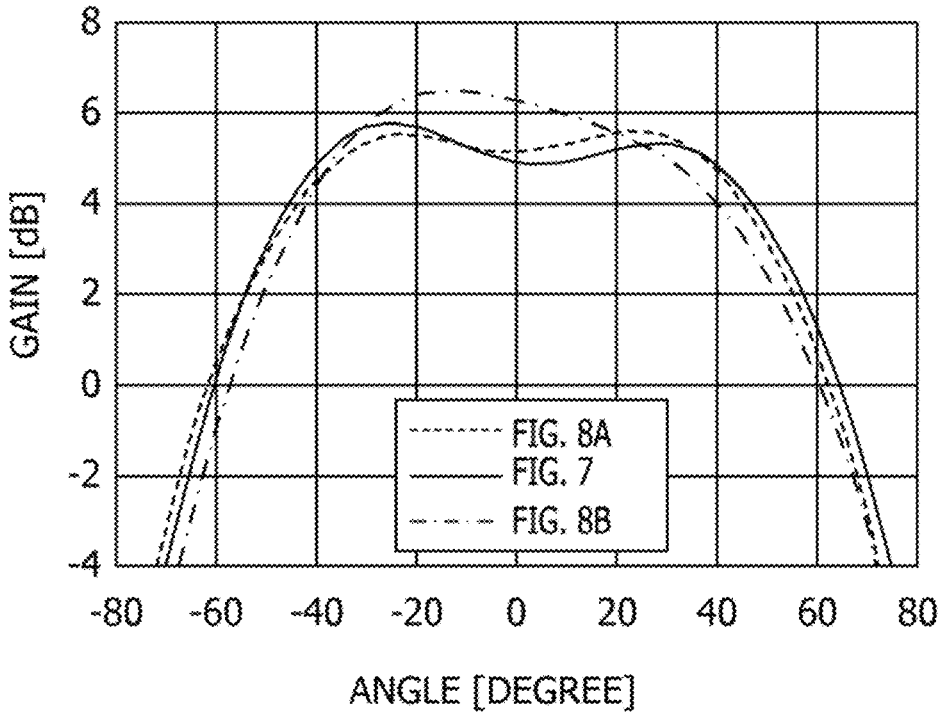
FIG. 10 illustrates the angular characteristics of the gain obtained by the simulation model.

FIG. 10 is a diagram illustrating angular characteristics of the gain obtained by the simulation model. As in FIG. 9, an angle of the horizontal axis is an angle on the XZ plane, zero degree indicates the +Z direction, 90 degrees indicates the +X direction, and −90 degrees indicates the −X direction. In FIG. 10, the characteristics of the simulation model in FIG. 8A are indicated by a broken line, and the characteristics of the simulation model in FIG. 8B are indicated by an alternate long and short dash line. These are the same as the characteristics illustrated in FIG. 9.

Furthermore, the characteristics indicated by a solid line in FIG. 10 is obtained based on the emission characteristics of the antenna element 120A (antenna element 120A on right side of dummy antenna element 120DR) positioned at the center in a case where the dummy antenna element 120DR illustrated in FIG. 7 is arranged instead of the dummy antenna element 120D of the simulation model in FIG. 8C.

As Illustrated in FIG. 10, the characteristics indicated by the solid line indicate the tendency similar to the characteristics of the simulation model in FIG. 8A indicated by the broken line and are substantially equal to the characteristics indicated by the solid line in FIG. 9. Therefore, it was possible to confirm that the improvement in the emission characteristics made by providing the dummy antenna element 120D is equivalent to a degree of the emission characteristics in a case where the dummy antenna element 120DR in FIG. 7 is provided.

Figure 11:
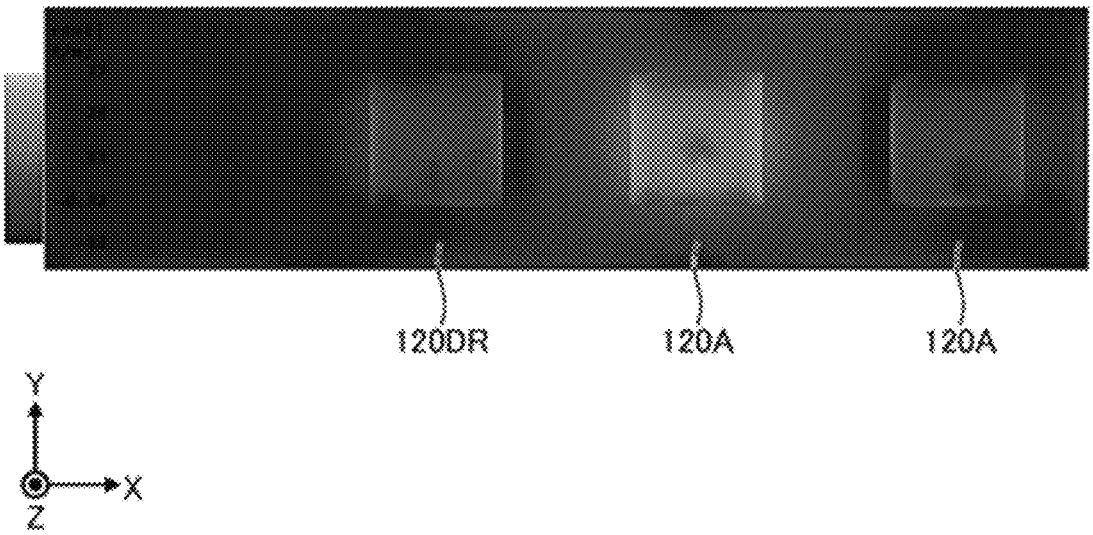
FIG. 11 is a diagram illustrating a current distribution in a case where radio waves are emitted from a central antenna element 120A of three elements including a dummy antenna element 120DR for comparison.

FIG. 11 is a diagram illustrating a current distribution in a case where the dummy antenna element 120DR for comparison (refer to FIG. 7), the antenna element 120A, and the antenna element 120A are arranged in the X direction and the central antenna element 120A of the three elements emits radio waves. Arrangement of such three elements is arrangement in which the dummy antenna element 120D in FIG. 8C is replaced with the dummy antenna element 120DR for comparison. Note that, here, the current distribution is illustrated in monotone. The higher (white) the brightness is, the more the current flows, and the lower (black) the brightness is, the less the current flows.

As Illustrated in FIG. 11, when the central antenna element 120A emits radio waves, it is found that, in the dummy antenna element 120DR for comparison on the left side, a current flows into an end extending in the Y direction on the +X direction side and an end extending in the Y direction on the −X direction side. Such a current distribution similarly appears in the rightmost antenna element 120A of the three elements, and it is found that the current distribution of the three elements in the X direction is horizontally symmetrical as viewed from the central antenna element 120A.

Figure 12:
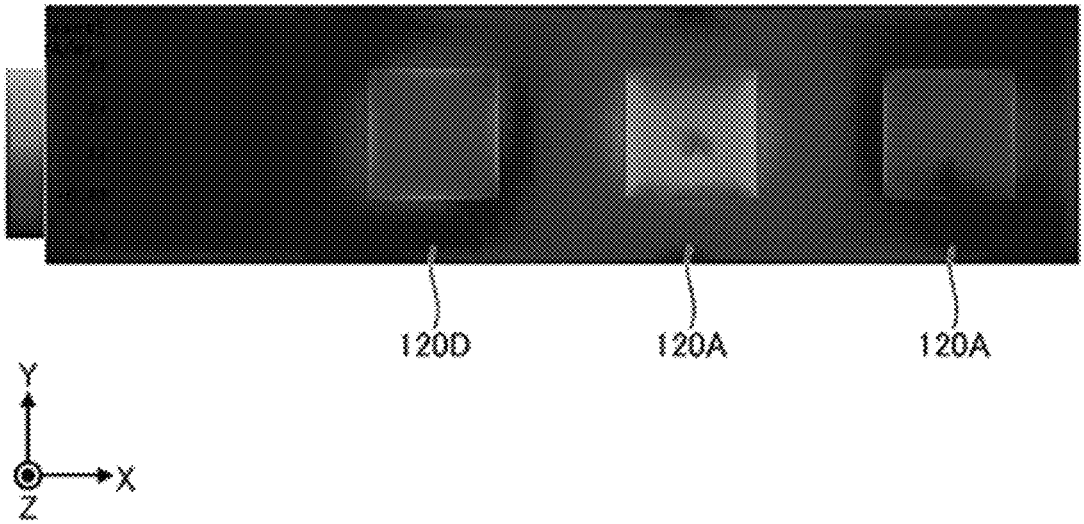
FIG. 12 is a diagram illustrating a current distribution in a case where radio waves are emitted from a central antenna element 120A among three elements including the dummy antenna element 120D.

FIG. 12 is a diagram illustrating a current distribution in a case where the dummy antenna element 120D, the antenna element 120A, and the antenna element 120A are arranged in the X direction and the central antenna element 120A of the three elements emits radio waves. Arrangement of such three elements is as illustrated in FIG. 8C. How to express the current distribution is the same as that in FIG. 11.

As Illustrated in FIG. 12, it is found that, in the dummy antenna element 120D, a current flows into an end extending in the Y direction on the +X direction side and an end extending in the Y direction on the +X direction side and a current flows into an end extending in the X direction on the +Y direction side and an end extending in the X direction on the −Y direction side. In other words, for example, currents flow in the four sides of the dummy antenna element 120D.

It is considered that the reason why the current flows in the four side of the dummy antenna element 120D in this way is that the current caused by the circularly polarized waves is generated by arranging the through-hole 121D at the position of the feeding point in a case where electric power is supplied at one point to generate the circularly polarized waves. Then, it is found that the current that flows into the end extending in the Y direction on the +X direction side of the dummy antenna element 120D and the end extending in the Y direction on the −X direction side is equivalent to the current that flows into the end extending in the Y direction on the +X direction side of the dummy antenna element 120DR for comparison in FIG. 11 and the end extending in the Y direction on the −X direction side.

Therefore, in FIG. 12, it is found that the current distribution in the X direction of the three elements (dummy antenna element 120D, antenna element 120A, and antenna element 120A) is horizontally symmetrical as viewed from the central antenna element 120A. In this way, it is found that, in the dummy antenna element 120D, the current distribution equivalent to the dummy antenna element 120DR for comparison connected to the dummy IC 150DR via the through-hole 121DR is obtained in the end extending in the Y direction on the +X direction side and the end extending in the Y direction on the −X direction side.

A part of a current generated by emission of the central antenna element 120A is consumed by the dummy IC 150DR in the dummy antenna element 120DR for comparison. The same applies to a case where the 50Ω terminating resistor is coupled instead of the dummy IC 150DR. On the other hand, in the dummy antenna element 120D, the current generated by the emission of the central antenna element 120A is branched into a current (current in horizontal direction (X direction)) generated in an end extending in the Y direction on the +X direction side and an end extending in the Y direction on the −X direction side and a current (current in vertical direction (Y direction)) generated in an end extending in the X direction on the +Y direction side and an end extending in the X direction on the −Y direction side. Such a current distribution is similar to the current distribution in a case where electric power is supplied at one point of a square patch antenna to generate circularly polarized waves.

In this way, a current caused by the circularly polarized wave is generated in the dummy antenna element 120D by coupling the through-hole 121D to a position offset from the center on the diagonal line of the square of the dummy antenna element 120D. Then, by generating the current caused by the circularly polarized waves, the current equivalent to the current that flows into the end extending in the Y direction on the +X direction side of the right-side antenna element 120A in FIG. 12 and the end extending in the Y direction on the −X direction side is generated into the end extending in the Y direction on the +X direction side of the dummy antenna element 120D and the end extending in the Y direction on the −X direction side. As a result, as illustrated in FIG. 12, the current distribution in the X direction (horizontal direction) of the three elements (dummy antenna element 120D, antenna element 120A, and antenna element 120A) can be horizontally symmetrical as viewed from the central antenna element 120A.

Next, an effect of the through-hole 121D will be examined with reference to FIGS. 13 to 16. FIGS. 13 to 16 are diagrams illustrating a current distribution in a simulation model for comparison. FIGS. 13 to 16 illustrate a current distribution of a portion corresponding to two elements including the central antenna element 120A and the left-side dummy antenna element 120D of the three elements illustrated in FIG. 12 in a case where the central antenna element 120A of the three elements illustrated in FIG. 12 emits radio waves.

Figure 13:
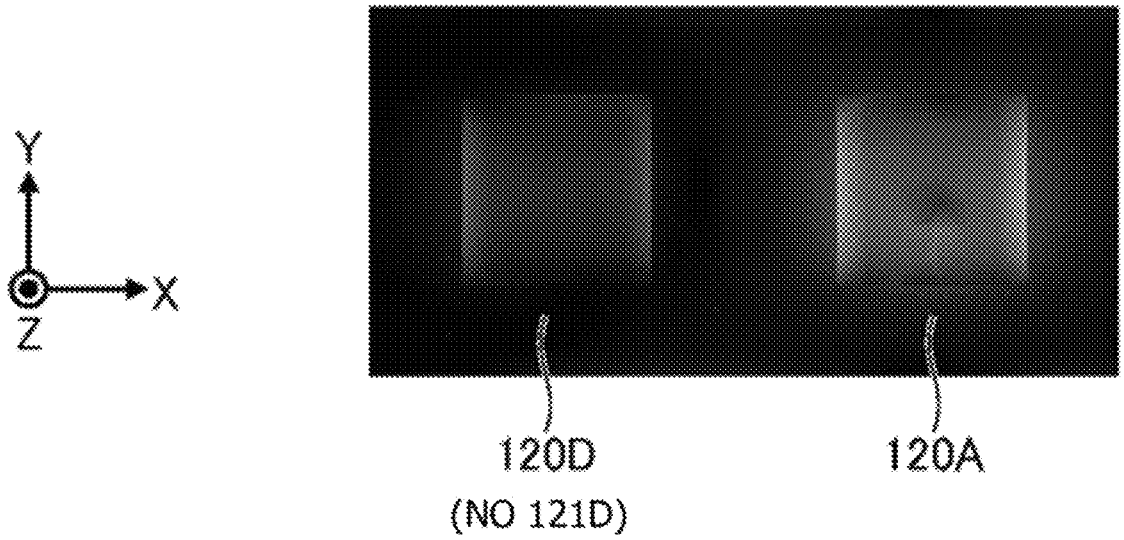
FIG. 13 is a diagram illustrating a current distribution in a simulation model for comparison.

FIG. 13 illustrates a current distribution of the dummy antenna element 120D from which the through-hole 1210 is removed. The dummy antenna element 120D in this case is potentially floating and is a non-feeding element having a floating potential. In FIG. 13, it is found that the current generated in the dummy antenna element 120D is too large in comparison with FIG. 12 and it is not possible to achieve equalization of the current distribution in the X direction.

Figure 14:
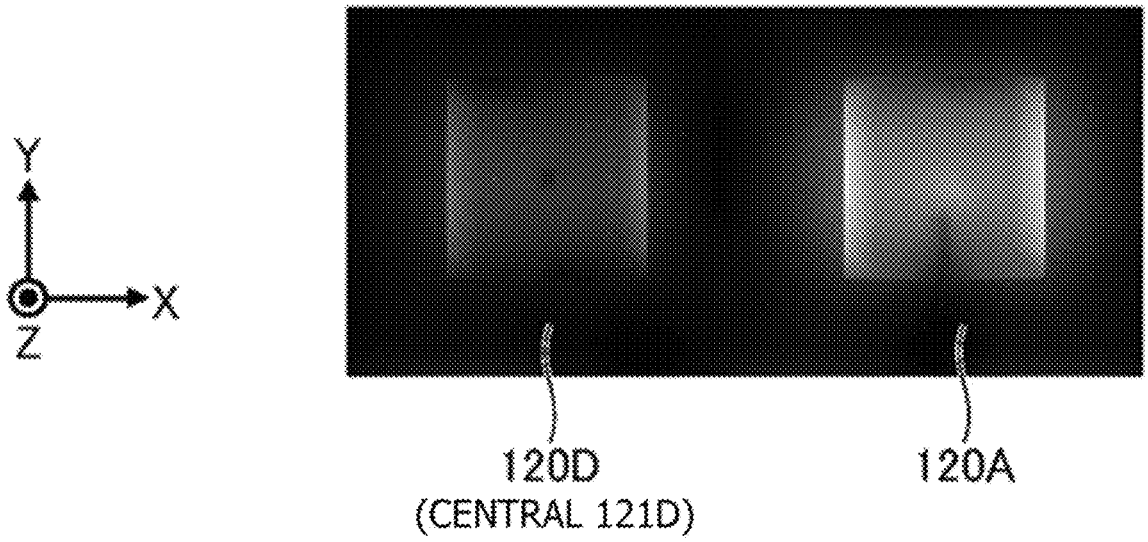
FIG. 14 is a diagram illustrating the current distribution in the simulation model for comparison.

FIG. 14 illustrates a current distribution in a case where the through-hole 121D is arranged at the center of the dummy antenna element 120D in a plan view. In FIG. 14, it is found that the current generated in the dummy antenna element 120D is too large in comparison with FIG. 12 and it is not possible to achieve equalization of the current distribution in the X direction.

Figure 15:
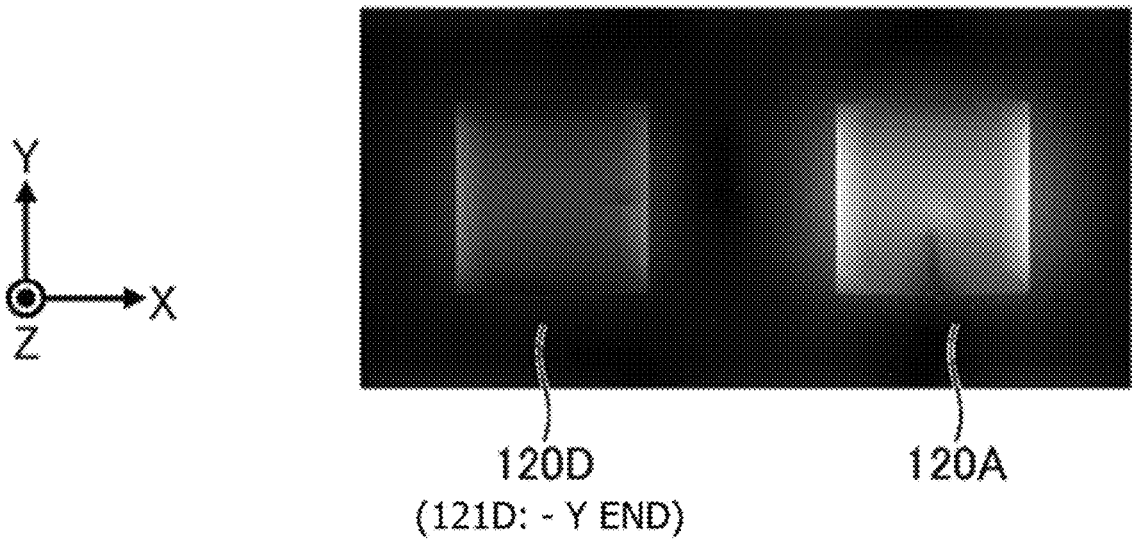
FIG. 15 is a diagram illustrating the current distribution in the simulation model for comparison.

FIG. 15 illustrates a current distribution in a case where the through-hole 121D is arranged at the center in the X direction of the end of the dummy antenna element 120D extending in the X direction on the −Y direction side. In FIG. 15, it is found that the current generated in the dummy antenna element 120D is too large in comparison with FIG. 12 and it is not possible to achieve equalization of the current distribution in the X direction.

Figure 16:
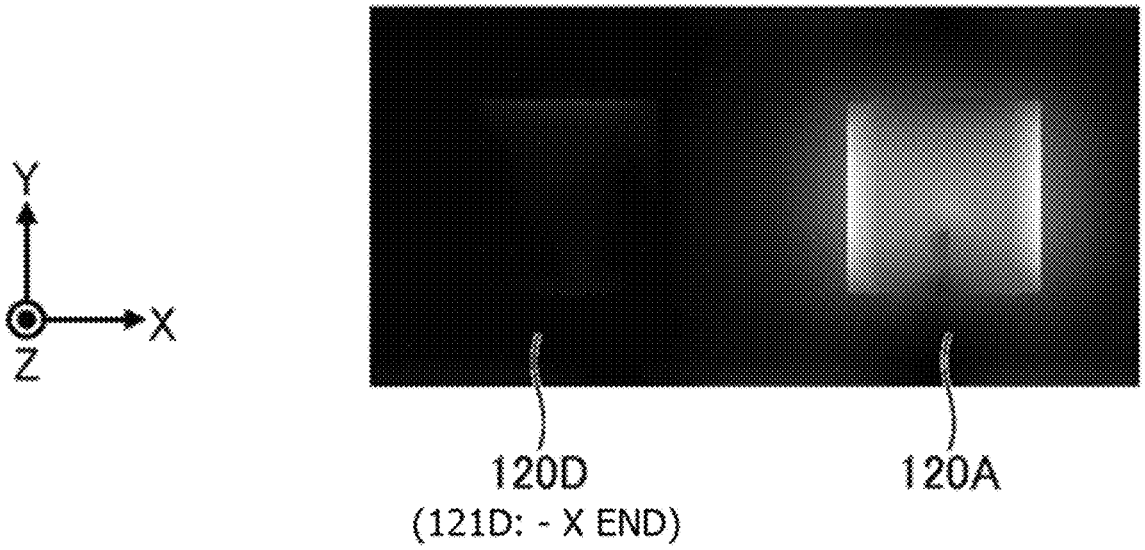
FIG. 16 is a diagram illustrating the current distribution in the simulation model for comparison.

FIG. 16 illustrates a current distribution in a case where the through-hole 121D is arranged at the center in the Y direction of the end of the dummy antenna element 120D extending in the Y direction on the −X direction side. In FIG. 16, it is found that the current generated in the dummy antenna element 120D is too small in comparison with FIG. 12 and it is not possible to achieve equalization of the current distribution in the X direction.

From the simulation results in FIGS. 13 to 16, it is important that the position of the through-hole 121D connected to the dummy antenna element 120D is a position where electric power is supplied at one point so that circularly polarized waves can be generated (position offset from center on diagonal line of square of dummy antenna element 120D as illustrated in FIGS. 4A and 4B). By arranging the through-hole 121D at such a position, it is possible to achieve the equalization of the current distribution in the X direction as illustrated in FIG. 12.

Therefore, the antenna device 100A and the antenna module 100 that improve the emission characteristics of the plurality of antenna elements arranged in an array can be provided. Furthermore, because the dummy antenna element 120D is coupled to the ground layer 130 via the through-hole 121D, it is not needed to provide the dummy IC 150DR (refer to FIG. 7) or the 50Ω terminating resistor on the lower surface side of the substrate 110. Therefore, it is possible to provide the antenna device 100A and the antenna module 100 that can save the space on the lower surface side of the substrate 110 and can reduce the cost.

Furthermore, because the dummy antenna element 120D has a shape in a plan view and a size equal to those of the antenna element 120A, the current distribution can be efficiently equalized, and the dummy antenna element 120D can be easily manufactured. Furthermore, because the position of the through-hole 121D is a position offset from the center on the diagonal line of the square of the dummy antenna element 120D, the position of the through-hole 121D can be easily specified, and the dummy antenna element 120D can be easily manufactured.

Note that, in the above, a form has been described in which the antenna module 100 includes the 64 antenna elements 120A arranged in an 8×8 array. However, because it is sufficient that the number of antenna elements 120A be plural and the antenna elements 120A be arranged in an array, the number and the arrangement of the antenna elements 120A are not limited to those described above. Furthermore, in the above, a form has been described in which the number of through-holes 121D is one. However, two through-holes 121D may be provided at positions of two feeding points in a case where electric power having a phase difference of 90 degrees is supplied using the two feeding points to generate circularly polarized waves and may be connected to the ground layer 130. Furthermore, in the above, a form has been described in which the antenna device 100A and the antenna module 100 perform 5G communication. However, applications of the antenna device 100A and the antenna module 100 are not limited to the 5G communication.

Figure 17:
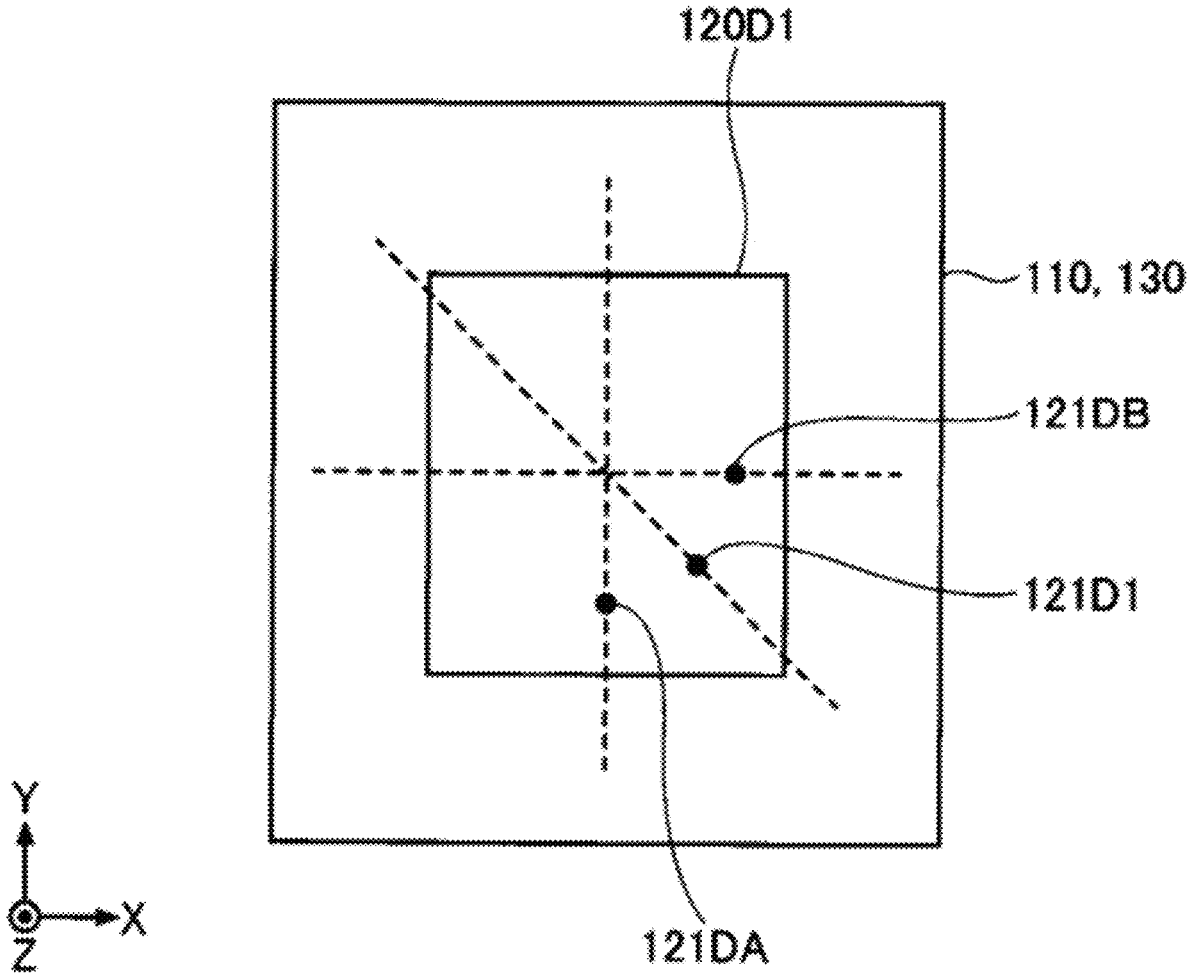
FIG. 17 is a diagram illustrating a dummy antenna element 120D1 according to a modification of the embodiment.
Figure 18:
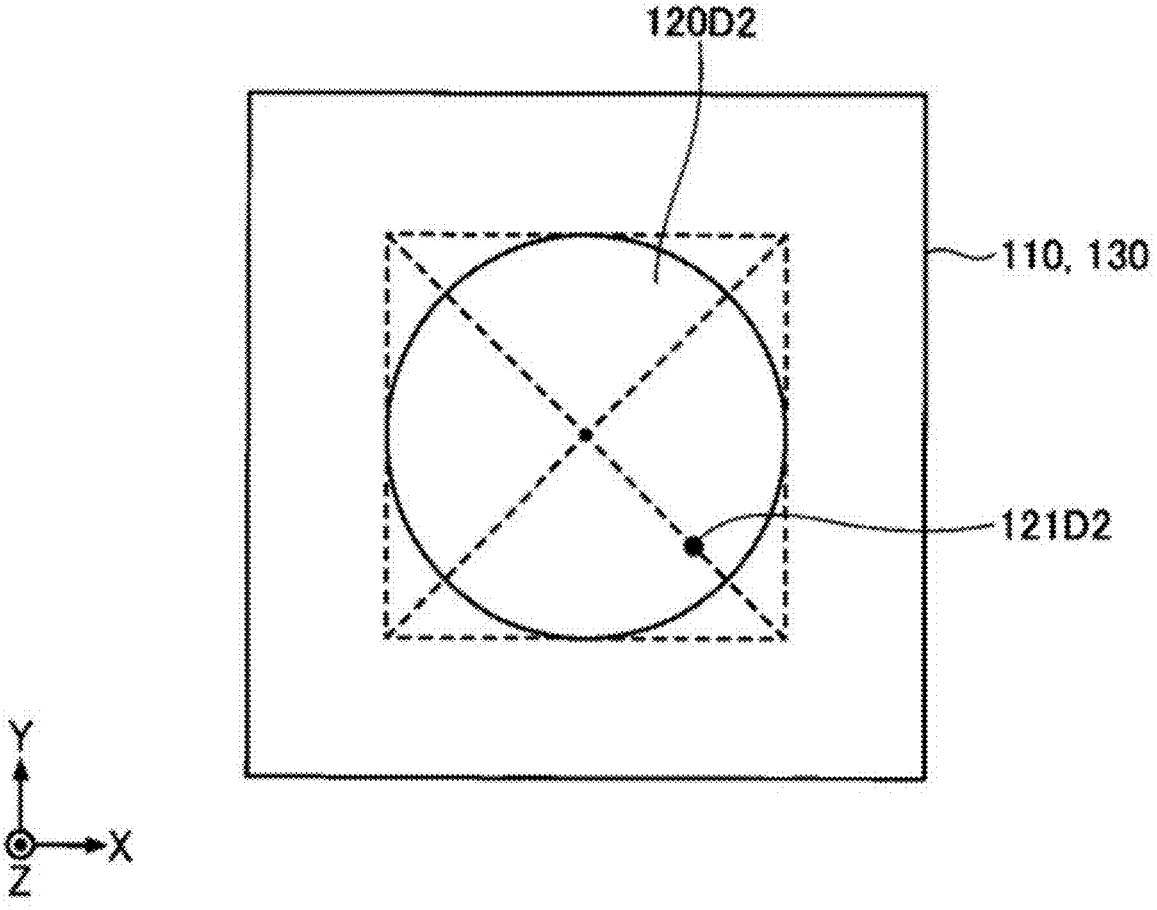
FIG. 18 is a diagram illustrating a dummy antenna element 120D2 according to the modification of the embodiment.

Furthermore, in the above, a form has been described in which the shape of the dummy antenna element 120D is a square. However, the dummy antenna element 120D may have the configuration illustrated in FIG. 17 or FIG. 18. FIGS. 17 and 18 are diagrams illustrating dummy antenna elements 120D1 and 120D2 according to a modification of the embodiment.

The dummy antenna element 120D1 illustrated in FIG. 17 is rectangular in a plan view. In a case of a rectangle, it is sufficient that a length of a side in an excitation direction (here, Y direction) be about ½ of the electrical length of the wavelength in the communication frequency. A position of the through-hole 121D1 is a position on a straight line that evenly divides an angle between two straight lines perpendicular to each other that connect two feeding points 121DA and 121DB in a case where the dummy antenna element 120D1 generates circularly polarized waves and the center of the dummy antenna element 120D1. Note that such a position is similar to the position of the through-hole 121D illustrated in FIGS. 4A and 4B. Furthermore, in a case where the dummy antenna element 120D1 is a rectangular in a plan view, the position of the through-hole 121D1 is not limited to the position on the straight line that evenly divides the angle between the two straight lines perpendicular to each other that connect the two feeding points 121DA and 121DB and the center of the dummy antenna element 120D1 and may be in the neighborhood of the straight line that evenly divides the angle. This is because the circularly polarized wave can be generated even if the position of the through-hole 121D1 is slightly deviated from the straight line that evenly divides the angle. Here, neighborhood means that the deviation from the straight line that evenly divides the angle is within a range where the circularly polarized waves can be generated.

The shape of the dummy antenna element 120D2 illustrated in FIG. 18 is a circle (perfect circle) in a plan view. In a case of a circle, it is sufficient that the diameter be about ½ of the electrical length of the wavelength in the communication frequency. The position of the through-hole 121D2 is a position offset from the center of the perfect circle on the diagonal line of the square that is circumscribed the perfect circle. The position of such a through-hole 121D2 is also the position on a straight line that evenly divides an angle between two straight lines perpendicular to each other that connect two feeding points in a case where the dummy antenna element 120D2 generates circularly polarized waves and the center of the dummy antenna element 120D2.

Although the antenna device and the antenna module according to the exemplary embodiment have been described above, the present invention is not limited to the embodiment disclosed in detail, and the various changes and alterations could be made hereto without departing from the scope of claims.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

What is claimed is:

1. An antenna device comprising:

a substrate;

a ground layer provided on a first surface of the substrate or in an inner layer of the substrate;

a plurality of antenna elements arranged on a second surface of the substrate in an array;

a plurality of dummy antenna elements arranged around the plurality of antenna elements in a plan view;

wherein, the plurality of antenna elements includes an antenna element, the antenna element is configured to construct a patch antennae, the plurality of dummy antenna elements includes a dummy antenna, the dummy antenna is coupled to the ground layer by a conductive through portion, the conductive through portion passing through the substrate in a thickness direction and having conductivity, and a position of the conductive through portion with respect to the dummy antenna element in a plan view is a first position on a straight line that evenly divides an angle between a first straight line and a second straight line, or a second position in the neighborhood of the first position, the first straight passing through a first feed point and a center of dummy antenna element, the second straight passing through a second feed point and the center of dummy antenna element, the first feed point and the second feed point being feed points when the dummy antenna element generates circularly polarized waves.

2. The antenna device according to claim 1, wherein, the first straight line and the second straight are orthogonal to each other.

3. The antenna device according to according to claim 1, wherein the dummy antenna element has a shape equal to the antenna element in a plan view.

4. The antenna device according to claim 1, wherein the dummy antenna element has a shape of a square in a plan view, and the position of the conductive through portion is a position on a diagonal line of the square.

5. The antenna device according to claim 1, wherein the dummy antenna element has a shape of a perfect circle in a plan view, and the position of the conductive through portion is a position on a diagonal line of a square that circumscribes the perfect circle.

6. The antenna device according to claim 1, wherein the conductive through portion includes two conductive through members provided at positions of the first feed point and the second feed point when the dummy antenna element generates circularly polarized waves.

7. The antenna device according to claim 1, wherein the plurality of antenna elements is N×N antenna elements of which N (N is integer equal to or more than two) antenna elements are arranged in each of a first axis direction and a second axis direction in a plan view, and the plurality of dummy antenna elements are arranged around the N×N antenna elements, N+2 dummy antenna elements included in the plurality of dummy antenna elements are arranged in the first axis direction, N+2 dummy antenna elements included in the plurality of dummy antenna elements are arranged in the second axis direction.

8. The antenna device according to claim 1, wherein the plurality of antenna elements and the plurality of dummy antenna elements are arranged at equal pitches in the first axis direction and the second axis direction in a plan view.

9. An antenna module comprising:

an antenna device includes:

a substrate, a ground layer provided on a first surface of the substrate or in an inner layer of the substrate, a plurality of antenna elements arranged on a second surface of the substrate in an array, a plurality of dummy antenna elements arranged around the plurality of antenna elements in a plan view; and a phase controller configured to control a phase of a radio wave transmitted or received via the plurality of antenna elements, wherein the plurality of antenna elements includes an antenna element, the antenna element is configured to construct a patch antennae, the plurality of dummy antenna elements includes a dummy antenna, the dummy antenna is coupled to the ground layer by a conductive through portion, the conductive through portion passing through the substrate in a thickness direction and having conductivity, and a position of the conductive through portion with respect to the dummy antenna element in a plan view is a first position on a straight line that evenly divides an angle between a first straight line and a second straight line, or a second position in the neighborhood of the first position, the first straight passing through a first feed point and a center of dummy antenna element, the second straight passing through a second feed point and the center of dummy antenna element, the first feed point and the second feed point being feed points when the dummy antenna element generates circularly polarized waves.

10. The antenna module according to claim 9, wherein the first straight line and the second straight are orthogonal to each other.

11. The antenna module according to claim 9, wherein phase controller is mounted on the first surface of the substrate.

* * * * *